US010777120B2

(12) United States Patent
Fang et al.

(10) Patent No.: US 10,777,120 B2
(45) Date of Patent: Sep. 15, 2020

(54) DRIVING APPARATUS FOR A DISPLAY PANEL AND OPERATION METHOD THEREOF

(71) Applicant: Novatek Microelectronics Corp., Hsinchu (TW)

(72) Inventors: Po-Hsiang Fang, Hsinchu (TW); Tzong-Honge Shieh, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 87 days.

(21) Appl. No.: 15/917,852

(22) Filed: Mar. 12, 2018

(65) Prior Publication Data

US 2019/0051232 A1 Feb. 14, 2019

Related U.S. Application Data

(60) Provisional application No. 62/542,763, filed on Aug. 8, 2017.

(51) Int. Cl.
*G09G 3/20* (2006.01)

(52) U.S. Cl.
CPC ..... *G09G 3/2096* (2013.01); *G09G 2310/027* (2013.01); *G09G 2310/0291* (2013.01); *G09G 2310/0297* (2013.01); *G09G 2310/08* (2013.01); *G09G 2330/12* (2013.01); *G09G 2350/00* (2013.01); *G09G 2370/045* (2013.01)

(58) Field of Classification Search
CPC ..... G09G 3/2096; G09G 2310/0291; G09G 2310/027; G09G 2310/08
IPC ..... G09G 3/2096,2310/0291, 2310/027, 2310/08
See application file for complete search history.

(56) References Cited

U.S. PATENT DOCUMENTS 6,388,388 B1 * 5/2002 Weindorf ..... G09G 3/3406 315/157
2004/0257328 A1 * 12/2004 Lim ..... G09G 3/3688 345/100
2009/0085848 A1 * 4/2009 Huang ..... G02B 6/0068 345/88
2009/0284545 A1 * 11/2009 Watanabe ..... G09G 3/3406 345/589
2011/0169797 A1 * 7/2011 Song ..... G09G 3/3614 345/209
2014/0285505 A1 * 9/2014 Nakanishi ..... G06T 1/20 345/545
2016/0189603 A1 * 6/2016 Lee ..... G09G 3/3258 345/212

(Continued)

*Primary Examiner* — Abbas I Abdulselam
(74) *Attorney, Agent, or Firm* — JCIPRNET

(57) ABSTRACT

A driving apparatus capable of driving a display panel and an operation method thereof are provided. The driving apparatus includes an output circuit, a receiver circuit and a multiplexer. The output circuit is configured to output a driving voltage for driving a data line of the display panel. The receiver circuit is configured to receive display data for driving the display panel to present an image. A first input terminal of the multiplexer is configured to receive information data, wherein the information data is not configured to drive the display panel to present an image. A second input terminal of the multiplexer is coupled to an output terminal of the receiver circuit. An output terminal of the multiplexer is coupled to an input terminal of the output circuit.

38 Claims, 8 Drawing Sheets

(56) References Cited

U.S. PATENT DOCUMENTS

2017/0235477 A1* 8/2017 Sherman ..... G06F 3/0238
715/744
2018/0166031 A1* 6/2018 Xiong ..... G02F 1/13306

* cited by examiner

DRIVING APPARATUS FOR A DISPLAY PANEL AND OPERATION METHOD THEREOF

CROSS-REFERENCE TO RELATED APPLICATION

This application claims the priority benefit of U.S. provisional application Ser. No. 62/542,763, filed on Aug. 8, 2017. The entirety of the above-mentioned patent application is hereby incorporated by reference herein and made a part of this specification.

BACKGROUND

Field of the Invention

The invention relates to a display apparatus and more particularly, to a driving apparatus for a display panel and an operation method thereof.

Description of Related Art

Generally, a driving apparatus can drive a display panel to present images. The driving apparatus may include a source driver and/or a gate driver. At present, a receiver circuit of the source driver receives pixel data from a timing controller (TCON), and then a digital-to-analog converter (DAC) of the source driver outputs a corresponding driving voltage, through operational amplifiers, to data lines of the display panel to drive the display panel to present images. If information data in the driving apparatus (i.e., an integrated circuit) has to be transmitted to other circuits (for example, a timing controller, a test apparatus or other integrated circuits), a conventional driving apparatus requires additional pins for outputting the information data. Based on a design demand, the information data in the driving apparatus may be state information of a state machine, bit error information, lock-status information and so on. If a great amount of bit data or complex data are to be transmitted, the conventional driving apparatus requires to transmit the data through additional interfaces (for example, an LVDS interface, an $I^2C$ interface or a custom-defined protocol interface). One can imagine that these additional pins and additional interfaces will lead to the increase in the area of the integrated circuit as well as the increase in the cost of package.

SUMMARY

The invention provides a driving apparatus for a display panel and an operation method thereof capable of outputting information data to other circuits/apparatuses on a premise that no additional pins are required.

According to an embodiment of the invention, a driving apparatus capable of driving a display panel is provided. The driving apparatus includes a first receiver circuit, a multiplexer and a first output circuit. The first output circuit is configured to output at least one driving voltage for driving at least one data line of the display panel. The first receiver circuit is configured to receive display data for driving the display panel to present an image. At least one first input terminal of the multiplexer is configured to receive information data. The information data is not configured to drive the display panel to present the image. At least one second input terminal of the multiplexer is coupled to at least one output terminal of the first output circuit. At least one output terminal of the multiplexer is coupled to at least one input terminal of the first output circuit.

According to an embodiment of the invention, an operation method of a driving apparatus for a display panel is provided. The operation method includes: receiving display data, by a first receiver circuit, for driving the display panel to present an image; selectively transmitting the display data output from the first receiver circuit or information data to at least one input terminal of a first output circuit by a multiplexer, wherein the information data is not configured to drive the display panel to present an image; and outputting at least one driving voltage, by the first output circuit, for driving at least one data line of the display panel.

Based on the above, the driving apparatus for the display panel and the operation method thereof provided by the embodiments of the invention can achieve outputting the information data and the display data by sharing the first output circuit. Thus, in some embodiments, the driving apparatus and the operation method thereof can achieve transmitting the complex information data on the premise that no additional pins are required, thereby saving the pin count. On the other hand, in some embodiments, a plurality of output channels of the first output circuit can simultaneously output the information data. Thus, the driving apparatus and the operation method thereof can achieve transmitting a great amount of information data within a short time, so as to save a transmission time of the information data. The saving of the transmission time can especially contribute to the efficiency of a testing procedure of integrated circuits.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
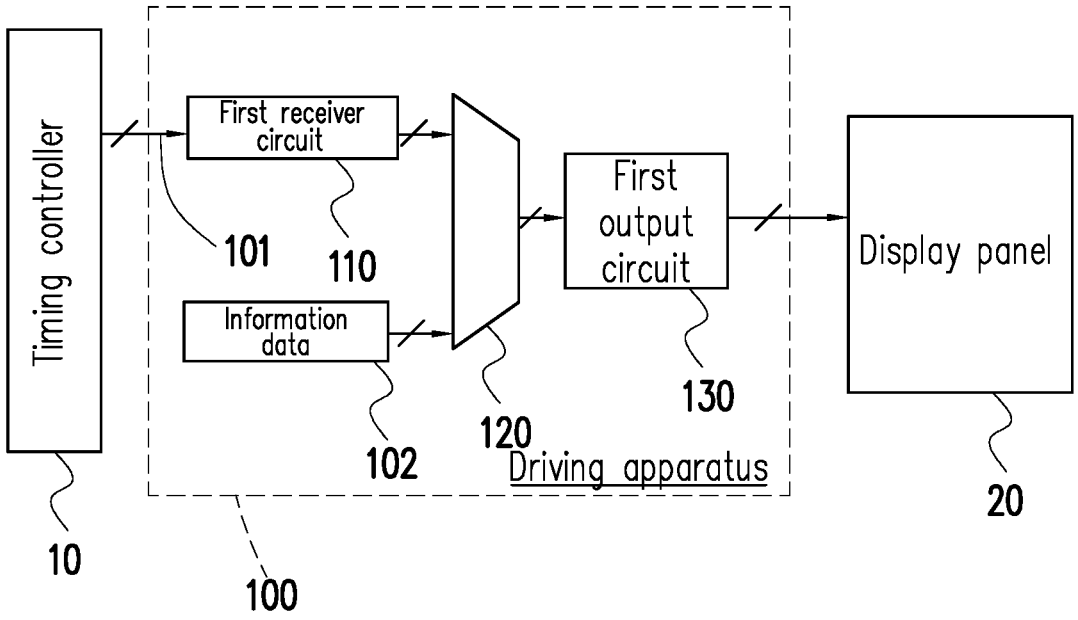
FIG. 1A and FIG. 1B are schematic circuit block diagrams illustrating a driving apparatus for a display panel according to an embodiment of the invention.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referral numerals in the drawings and description refer to the same or like parts. Components/members/steps using the same referral numerals or using the same terms in different embodiments may cross-refer related descriptions.

Figure 1B:
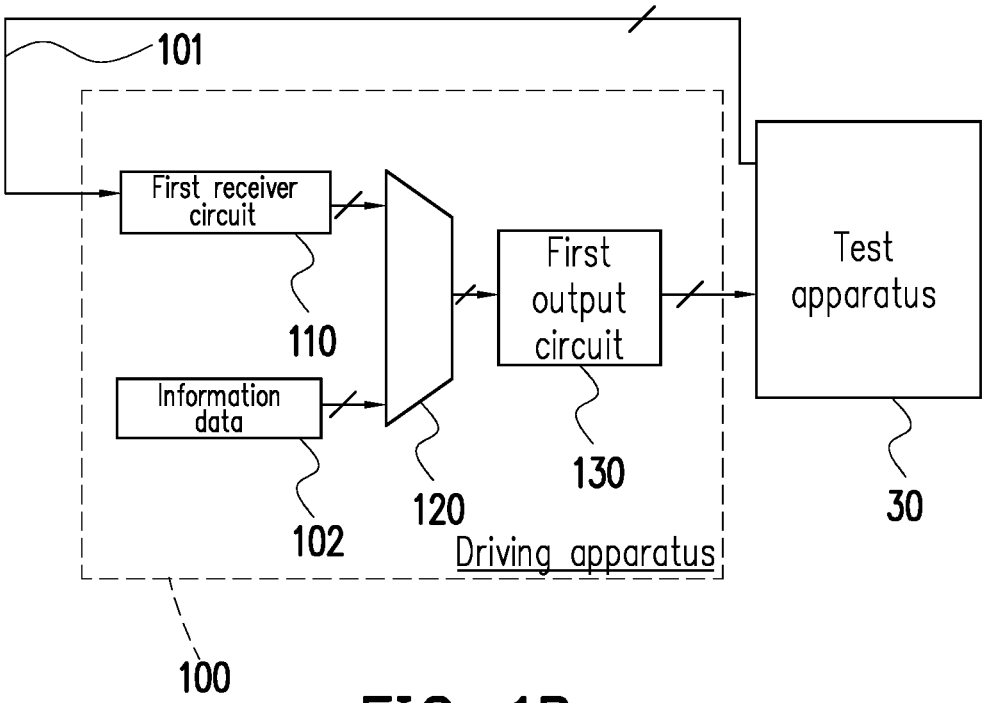

FIG. 1A and FIG. 1B are schematic circuit block diagrams illustrating a driving apparatus 100 for a display panel according to an embodiment of the invention. According to the control of a timing controller 10, the driving apparatus 100 may drive a display panel 20. Based on a design demand, the display panel 20 may be a liquid crystal display (LCD) panel, an organic light emitting diode (OLED) display panel or any other type display panel. In the embodiment illustrated in FIG. 1A and FIG. 1B, the driving apparatus 100 may serve as a source driver of the display panel 20. Based on a design demand, in other embodiments, the driving apparatus 100 may also include a gate driver.

The driving apparatus 100 includes a first receiver circuit 110, a multiplexer 120 and a first output circuit 130. Based on a design demand, in some embodiments, the first receiver circuit 110 may include a built-in self-test (BIST) pattern generation circuit (which is not shown). In a test mode, the BIST pattern generation circuit may generate image data indicating at least one predetermined image pattern to the first output circuit 130 through the multiplexer 120. The first output circuit 130 may generate/output at least one driving voltage according to the image data of the BIST pattern generation circuit. In some other embodiments, the first receiver circuit 110 may not include the BIST pattern generation circuit.

Figure 2:
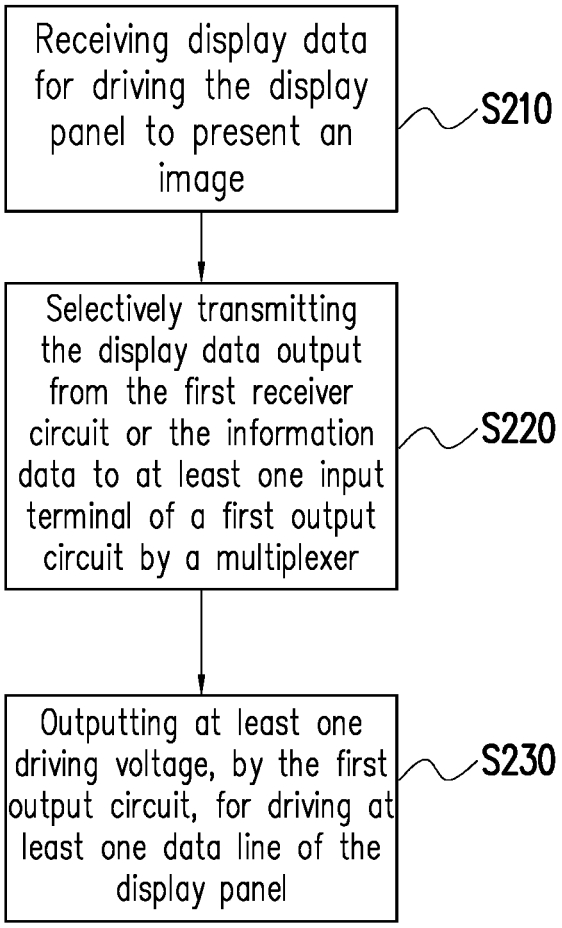
FIG. 2 is a flowchart illustrating an operation method of the driving apparatus for the display panel according to an embodiment of the invention.

FIG. 2 is a flowchart illustrating an operation method of the driving apparatus 100 for the display panel according to an embodiment of the invention. Referring to FIG. 1A (or FIG. 1B) and FIG. 2. In step S210, the first receiver circuit 110 receives display data 101. At least one first input terminal of the multiplexer 120 may receive information data 102. Therein, the display data 101 is configured to drive the display panel to present an image, while the information data 102 is not configured to drive the display panel to present the image. Based on a design demand, the information data 102 may be any information related to the driving apparatus 100, but not include pixel data. For instance, the information data 102 may include a bit error number, analog-to-digital bit information, state information and/or other information (which does not include pixel data) of the driving apparatus 100. At least one second input terminal of the multiplexer 120 is coupled to at least one output terminal of the first receiver circuit 110 to receive the display data. At least one output terminal of the multiplexer 120 is coupled to at least one input terminal of the first output circuit 130.

In step S220, the multiplexer 120 may selectively transmit the information data 102 or the display data 101 output by the first receiver circuit 110 to an input terminal of the first output circuit 130. The first output circuit 130 may convert digital data of the input terminal of the first output circuit 130 into an analog voltage and output the analog voltage through at least one output terminal of the first output circuit 130. In step S230, the at least one output terminal of the first output circuit 130 may output at least one driving voltage. The driving voltage may be configured to drive at least one data line of the display panel 20.

FIG. 1A is the schematic diagram illustrating a scenario that the driving apparatus 100 is applied in a display apparatus product. In the implementation example illustrated in FIG. 1A, the first receiver circuit 110 receives the display data 101 from the timing controller 10. The multiplexer 120 may select to transmit the display data of the first receiver circuit 110 to the first output circuit 130. Thus, the first output circuit 130 may convert the display data into the corresponding driving voltage. The first output circuit 130 is coupled to the at least one data line of the display panel 20 to output at least one driving voltage for driving the display panel 20 to present the image. Based on a design demand, timing controller 10 may be a conventional timing controller or any other timing controller circuit, and the display panel 20 may be a conventional display panel or any other display panel and thus, will not be repeatedly described.

When the driving apparatus 100 is operated in a normal operation mode, the multiplexer 120 may selectively transmit the display data of the first receiver circuit 110 to the input terminal of the first output circuit 130, such that the first output circuit 130 may drive the at least one data line of the display panel 20. When the driving apparatus 100 is operated in a particular mode, the multiplexer 120 may selectively transmit the information data 102 to the input terminal of the first output circuit 130.

FIG. 1B is a schematic diagram illustrating that the driving apparatus 100 is tested in a test environment. In the implementation example illustrated in FIG. 1B, the first receiver circuit 110 receives the display data 101 from a test apparatus 30. Based on a design demand, the test apparatus 30 may be a conventional testing platform/circuit or any other test apparatus and thus, will not be repeatedly described. When the driving apparatus 100 is operated in the normal operation mode, the multiplexer 120 may selectively transmit the display data of the first receiver circuit 110 to the input terminal of the first output circuit 130, such that the first output circuit 130 may output a driving voltage corresponding to the display data to the test apparatus 30. Thereby, the test apparatus 30 may verify whether the driving voltage output by the driving apparatus 100 may meet the display data 101 provided by the test apparatus 30.

When the driving apparatus 100 is operated in the particular mode, the multiplexer 120 may selectively transmit the information data 102 to the input terminal of the first output circuit 130. In some embodiments, the information data 102 may indicate operation information of the driving apparatus 100. In the particular mode, the first output circuit 130 may convert the information data 102 in a digital format into the analog voltage and output the analog voltage (i.e., the information data 102 in an analog format) to the test apparatus 30 through the at least one output terminal of the first output circuit 130. Thereby, the test apparatus 30 may verify whether the operation of the driving apparatus 100 may meet expectations.

Figure 3:
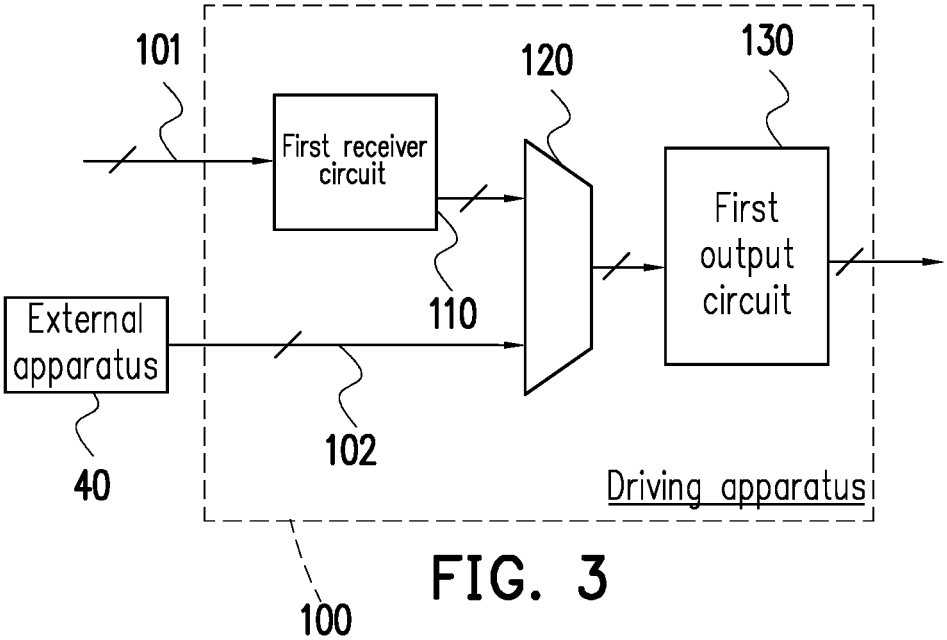
FIG. 3 is a schematic diagram illustrating a source providing the information data of the driving apparatus depicted in FIG. 1 according to an embodiment of the invention.

FIG. 3 is a schematic diagram illustrating a source providing the information data 102 of the driving apparatus 100 depicted in FIG. 1 according to an embodiment of the invention. In the embodiment illustrated in FIG. 3, the driving apparatus 100 is further coupled to an external device 40. Based on a design demand, the external device 40 may be a device (e.g., a printed circuit board), a display panel, a test apparatus or any other device/circuit including a timing controller. The external device 40 may provide external information to the driving apparatus 100, such that the driving apparatus 100 may obtain the information data 102. Taking the circuit illustrated in FIG. 3 as an example, the driving apparatus 100 may receive the external information from the external device 40 and directly serve it as the information data 102. In other embodiments, the driving apparatus 100 may process the external information provided from the external device 40 to obtain the information data 102.

For instance, it is assumed that the external device 40 may be an OLED display panel, and the external information may be a voltage (or current) sensing result of the OLED display panel. In the particular mode, the first output circuit 130 may obtain the voltage (or current) sensing result of the OLED display panel through the multiplexer 120. The first output circuit 130 may output the voltage (or current) sensing result to another external device (for example, a timing controller or a test apparatus which is not shown) through the at least one output terminal of the first output circuit 130.

Figure 4:
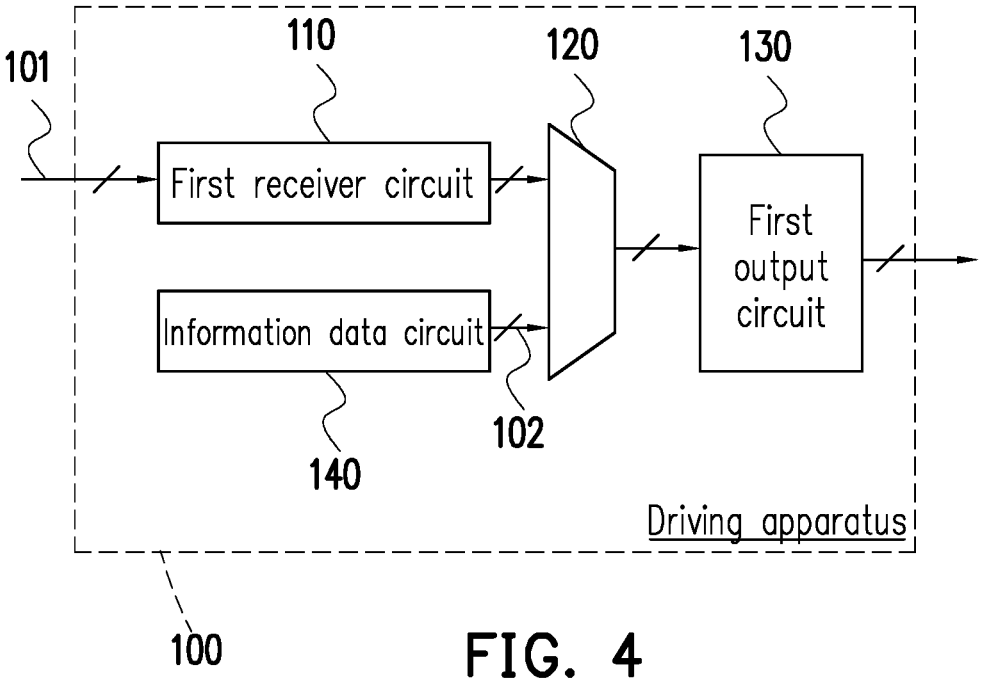
FIG. 4 is a schematic diagram illustrating a source providing the information data of the driving apparatus depicted in FIG. 1 according to another embodiment of the invention.

FIG. 4 is a schematic diagram illustrating a source providing the information data 102 of the driving apparatus 100 depicted in FIG. 1 according to another embodiment of the invention. In the embodiment illustrated in FIG. 4, the driving apparatus 100 further includes an information data circuit 140. The information data circuit 140 may provide the information data 102 to the multiplexer 120. In the embodiment illustrated in FIG. 4, the information data circuit 140 may internally generate information data 102 rather than receiving any information from any external apparatuses. For instance, the information data circuit 140 may include a state information register of a finite state machine of the driving apparatus 100. The state information register may provide state information of the driving apparatus 100 to serve it as the information data 102. In other embodiments, the information data circuit 140 may receive external information from an external apparatus and correspondingly generate the information data 102 according to the external information.

Figure 5:
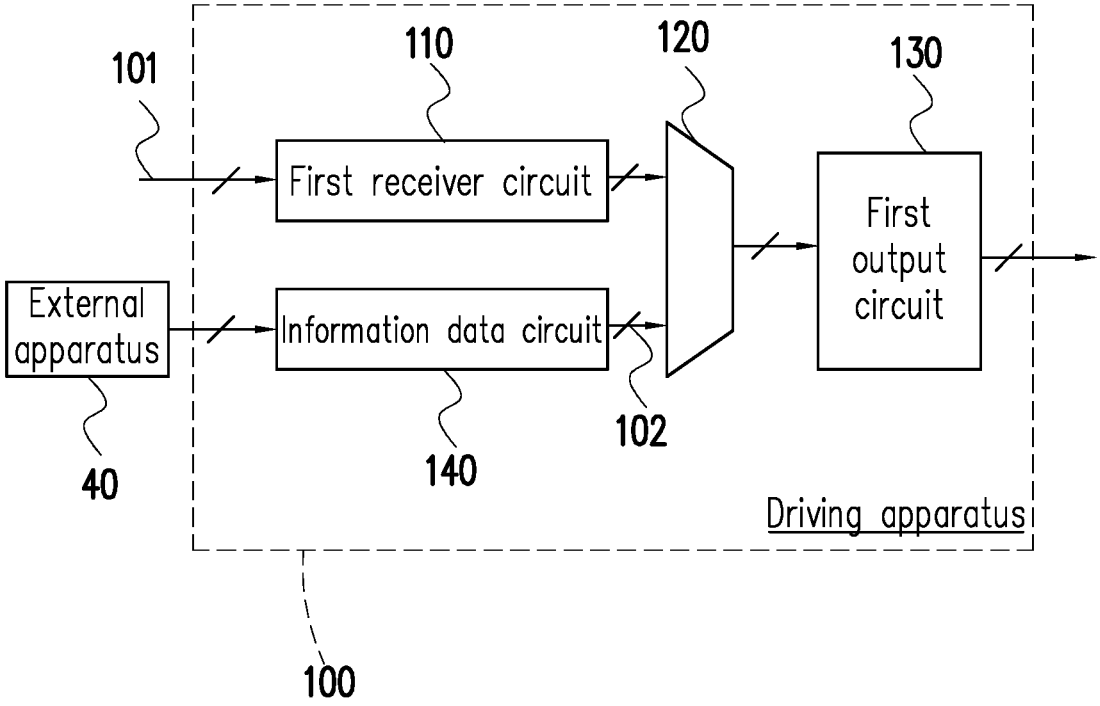
FIG. 5 is a schematic diagram illustrating a source providing the information data of the driving apparatus depicted in FIG. 1 according to yet another embodiment of the invention.

FIG. 5 is a schematic diagram illustrating a source providing the information data 102 of the driving apparatus 100 depicted in FIG. 1 according to yet another embodiment of the invention. In the embodiment illustrated in FIG. 5, the information data circuit 140 of the driving apparatus 100 is coupled to an external device 40. The external device 40 illustrated in FIG. 5 may refer to the related description of that illustrated in FIG. 3 and thus, will not be repeatedly described. The external device 40 may provide the external information to the information data circuit 140. The information data circuit 140 may generate the information data 102 according to the external information to the multiplexer 120.

Figure 6A:
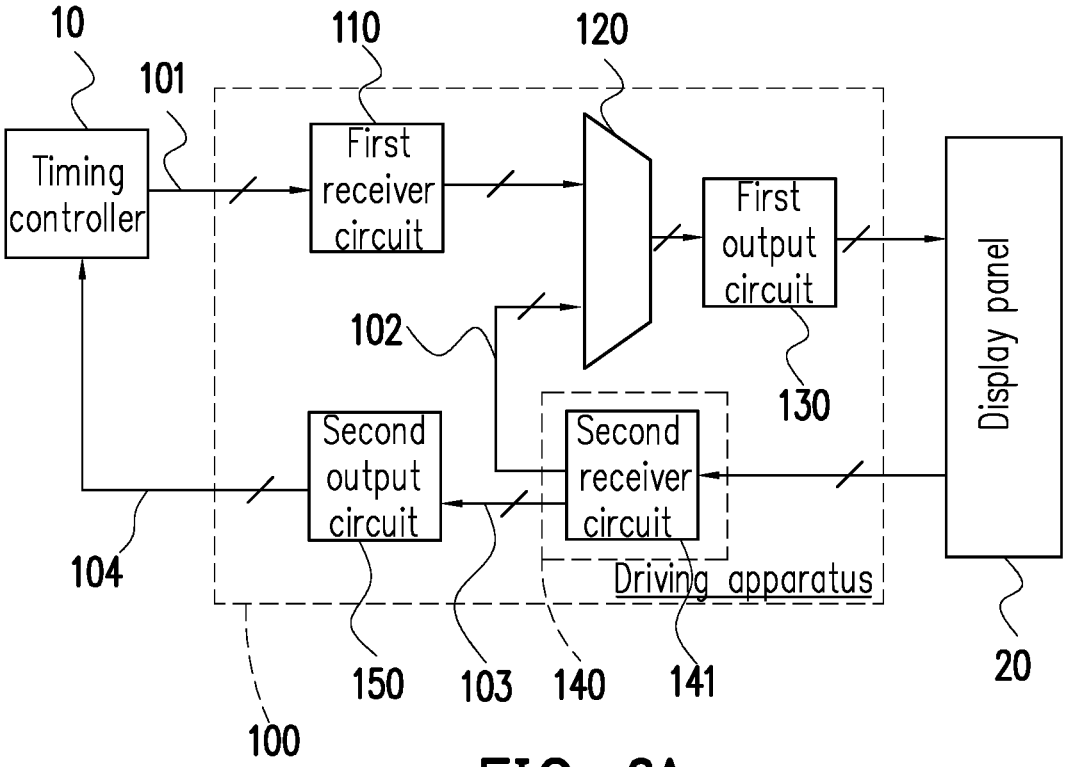
FIG. 6A and FIG. 6B are schematic diagrams illustrating that the driving apparatus depicted in FIG. 5 is applied in various environments according to an embodiment of the invention.
Figure 6B:
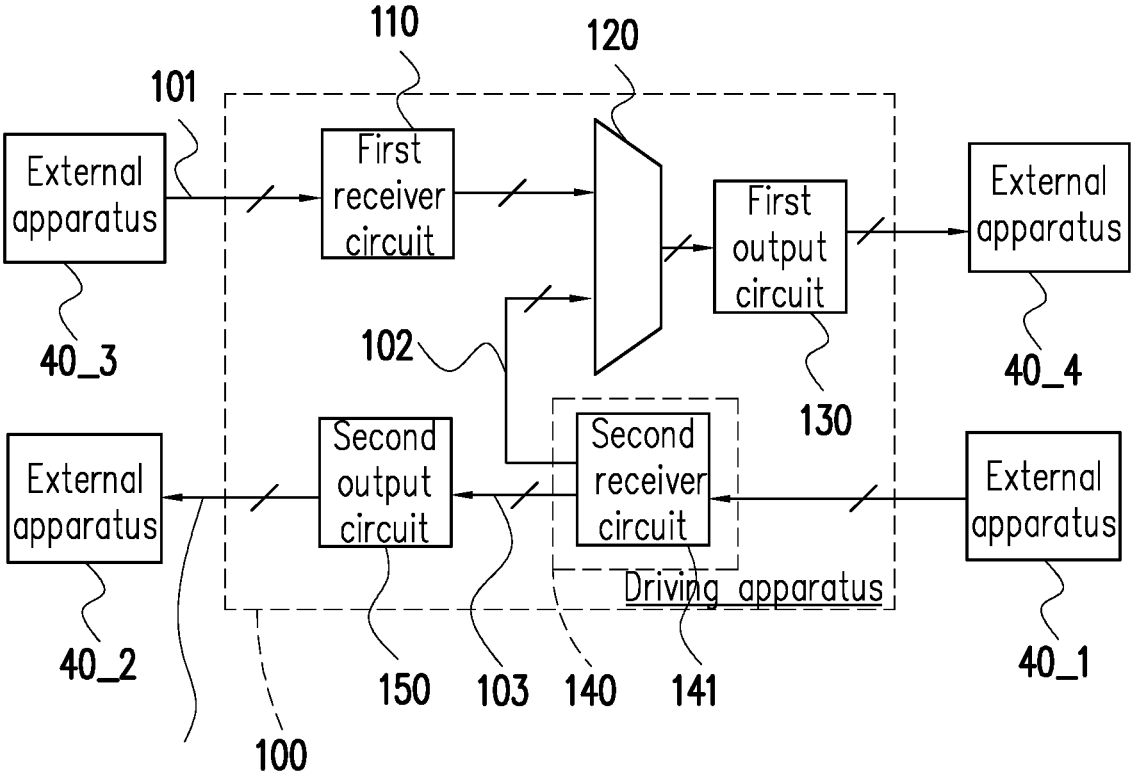

FIG. 6A and FIG. 6B are schematic diagrams illustrating that the driving apparatus 100 depicted in FIG. 5 is applied in various environments according to an embodiment of the invention. In the implementation examples illustrated in FIG. 6A and FIG. 6B, the information data circuit 140 of the driving apparatus 100 includes a second receiver circuit 141, and the driving apparatus 100 further includes a second output circuit 150.

FIG. 6A is the schematic diagram illustrating a scenario that the driving apparatus 100 is applied in a display apparatus product. FIG. 6B is a schematic diagram illustrating that the driving apparatus 100 is tested in a test environment illustrated in FIG. 5. In the particular mode, the second receiver circuit 141 may receive the external information from the external device 40_1 and generate the information data 102 according to the external information to the multiplexer 120. In normal mode, the second receiver circuit 141 may convert the voltage (or current) sensing result of the display panel 20 into sensing data 103 and provide it to the second output circuit 150. The second output circuit 150 may, in normal mode, receive the sensing data 103 output by the second receiver circuit 141. According to the received sensing data 103, the second output circuit 150 may provide output data 104 to the timing controller 10 illustrated in FIG. 6A or the external device 40_2 illustrated in FIG. 6B.

The first receiver circuit 110 receives the display data 101 from the timing controller 10 illustrated in FIG. 6A or the external device 40_3 illustrated in FIG. 6B. The multiplexer 120 may select to transmit the display data of the first receiver circuit 110 to the first output circuit 130 in the normal mode, and transmit the information data 102 to the first output circuit 130 in the particular mode. Thus, the first output circuit 130 may convert the data output from the first output circuit 130 into the corresponding voltage, and output the corresponding voltage to the external device 40_4. The external devices 40_1 to 40_4 may be the same apparatus or different apparatus. For example, the external devices 40_1 to 40_4 may be the test apparatus 30 illustrated in FIG. 1B.

Figure 7:
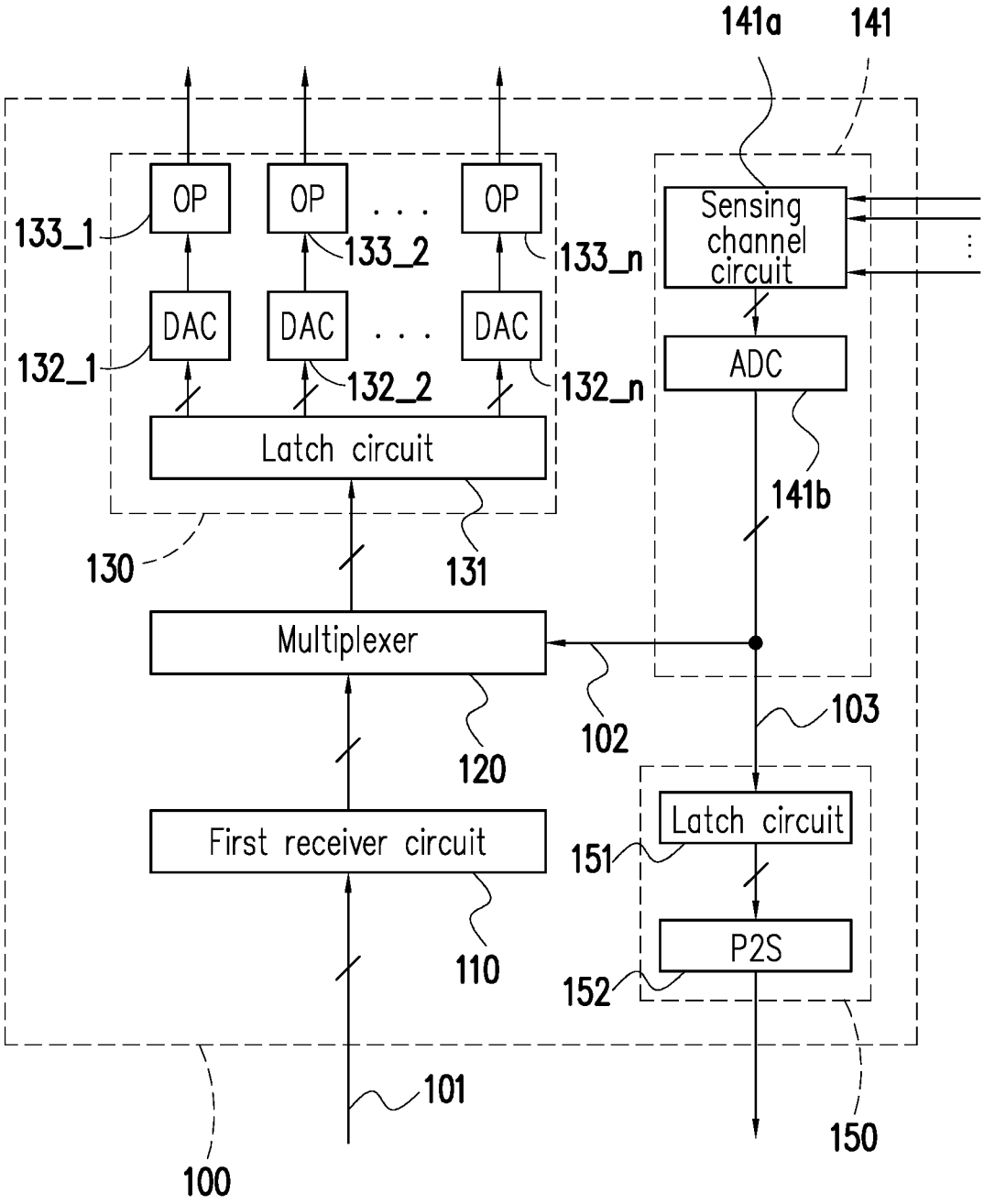
FIG. 7 is a schematic circuit block diagram illustrating the first output circuit, the second receiver circuit and the second output circuit depicted in FIG. 6A and FIG. 6B according to an embodiment of the invention.

FIG. 7 is a schematic circuit block diagram illustrating the first output circuit 130, the second receiver circuit 141 and the second output circuit 150 depicted in FIG. 6A and FIG. 6B according to an embodiment of the invention. In the embodiment illustrated in FIG. 7, the first output circuit 130 includes a latch circuit 131 and at least one digital-to-analog converter (DAC), for example, DACs 132_1, 132_2, . . . and **132_*n* illustrated in FIG. 7. The latch circuit 131 may receive and latch the output from the multiplexer 120 and output latched data to the DACs 132_1 to 132_*n*. The DACs 132_1 to 132_*n* may convert the digital data into an analog voltage. The first output circuit 130 further includes at least one operational amplifier (OP), for example, OPs 133_1, 133_2, . . . and 133_*n* illustrated in FIG. 7. Input terminals of the OPs 133_1 to 133_*n* are respectively coupled to output terminals of the DACs 132_1 to 132_*n* to receive the analog voltage. When the driving apparatus 100 is coupled to the display panel 20, output terminals of the OPs 133_1 to 133_*n* may be respectively coupled to different data lines of the display panel 20**.

In the embodiment illustrated in FIG. 7, the second receiver circuit 141 includes a sensing channel circuit **141*a* and an analog-to-digital converter (ADC) 141*b*. When the driving apparatus 100 is coupled to the display panel 20, an input terminal of the sensing channel circuit 141*a* may be coupled to a sensing terminal of the display panel 20. The sensing channel circuit 141*a* may sense a voltage (or a current) of the display panel 20 to output a voltage (or current) sensing result to the ADC 141*b*. An input terminal of the ADC 141*b* is coupled to an output terminal of the sensing channel circuit 141*a*. The ADC 141*b* may convert the voltage (or current) sensing result into at least one digital signal. In the embodiment illustrated in FIG. 7, the at least one digital signal may be directly provided to the multiplexer 120 to serve as the information data 102, and the at least one digital signal may be directly provided to the second output circuit 150 to serve as the sensing data 103**.

In the embodiment illustrated in FIG. 7, the second output circuit 150 includes a latch circuit 151 and a parallel-to-serial (P2S) circuit 152. An input terminal of the latch circuit 151 is coupled to an output terminal of the second receiver circuit 141. The latch circuit 151 may latch the sensing data 103 (or the information data 102) from the second receiver circuit 141. An input terminal of the P2S circuit 152 is coupled to an output terminal of the latch circuit 151. The P2S circuit 152 may convert the sensing data 103 (or the information data 102) in a parallel format into a serial format. When the driving apparatus 100 is coupled to the timing controller 10, the input terminal of the sensing channel circuit 141*a* may be coupled to a sensing signal input terminal of the timing controller 10.

Figure 8:
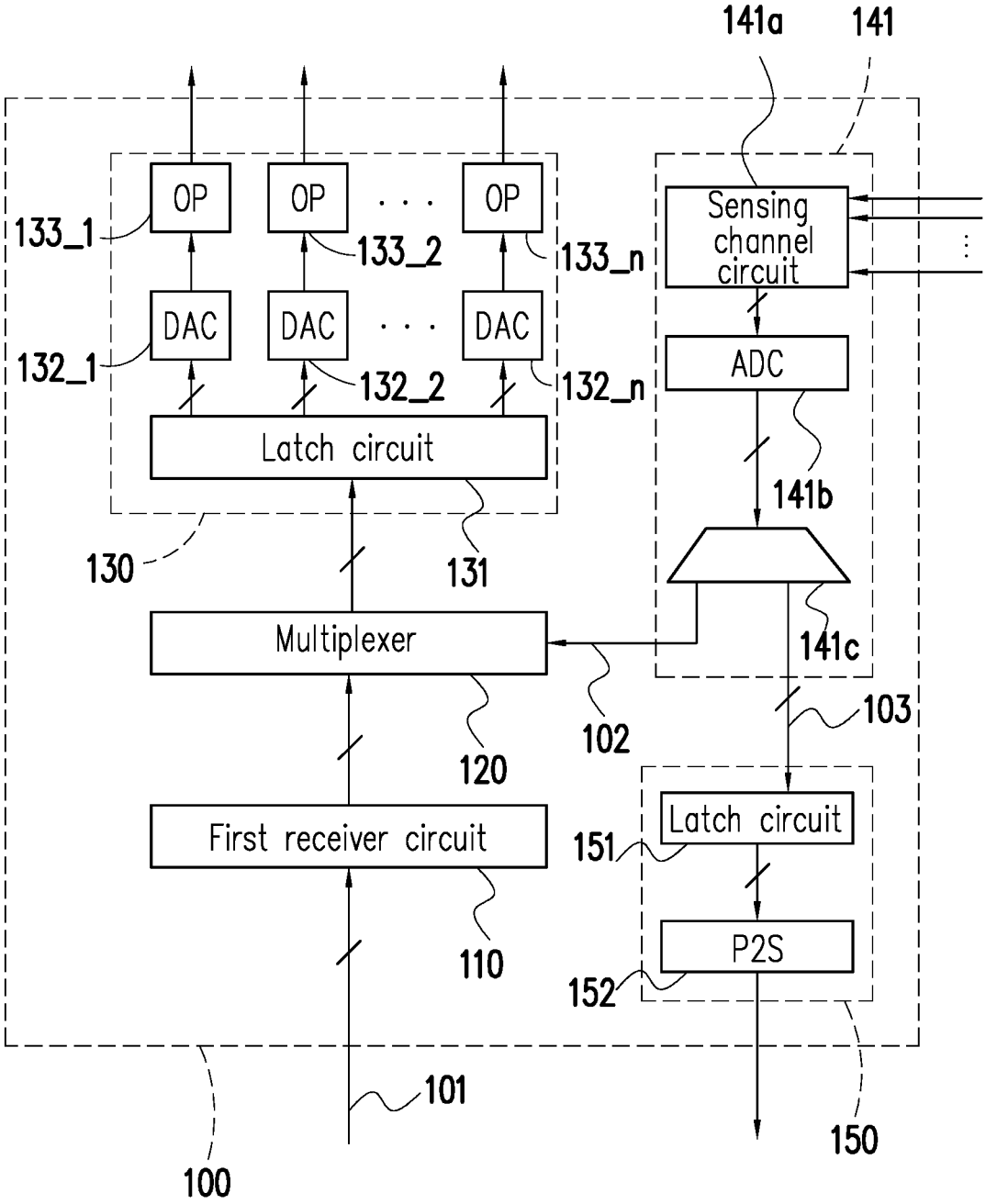
FIG. 8 is a schematic circuit block diagram illustrating the second receiver circuit depicted in FIG. 6A and FIG. 6B according to another embodiment of the invention.

FIG. 8 is a schematic circuit block diagram illustrating the second receiver circuit 141 depicted in FIG. 6A and FIG. 6B according to another embodiment of the invention. The second receiver circuit 141 includes a sensing channel circuit 141*a*, an ADC 141*b* and a demultiplexer 141*c*. The first output circuit 130, the latch circuit 131, the DACs 132_1 to 132_*n*, the OPs 133_1 to 133_*n*, the second receiver circuit 141, the sensing channel circuit 141*a*, the ADC 141*b*, the second output circuit 150, the latch circuit 151 and the P2S circuit 152 illustrated in FIG. 8 may refer to the related descriptions of those illustrated in FIG. 7 and thus, will not be repeatedly described.

In the embodiment illustrated in FIG. 8, at least one input terminal of the demultiplexer 141*c* is coupled to at least one output terminal of the ADC 141*b*. At least one first output terminal of the demultiplexer 141*c* is coupled to the at least one first input terminal of the multiplexer 120 to provide the information data 102. At least one second output terminal of the demultiplexer 141*c* is coupled to at least one input terminal of the second output circuit 150 to provide the sensing data 103. When the driving apparatus 100 is operated in the normal operation mode, the demultiplexer 141*c* may selectively transmit the digital signal output by the ADC 141*b* to the second output circuit 150 to serve it as the sensing data 103. When the driving apparatus 100 is operated in the particular mode (e.g., a test mode), the demultiplexer 141*c* may selectively transmit the digital signal output by the ADC 141*b* to the multiplexer 120 to serve it as the information data 102.

Figure 9:
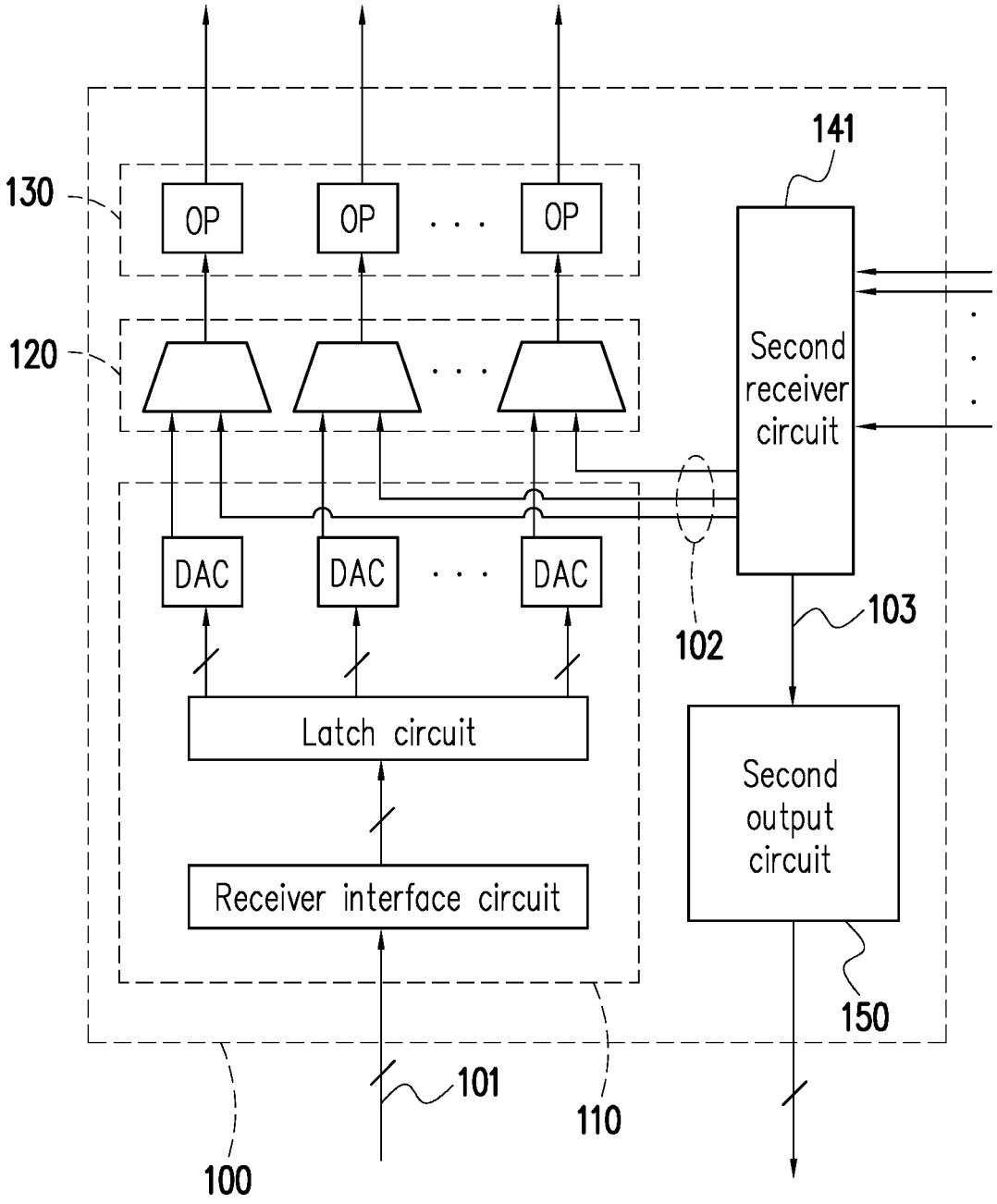
FIG. 9 is a schematic circuit block diagram illustrating the first receiver circuit, the multiplexer and the first output circuit depicted in FIG. 6A and FIG. 6B according to yet another embodiment of the invention.

FIG. 9 is a schematic circuit block diagram illustrating the first receiver circuit 110, the multiplexer 120 and the first output circuit 130 depicted in FIG. 6A and FIG. 6B according to yet another embodiment of the invention. The second receiver circuit 141 and the second output circuit 150 illustrated in FIG. 9 may refer to the related descriptions of those illustrated in FIG. 7 and/or FIG. 8 and thus, will not be repeatedly described.

In the embodiment illustrated in FIG. 9, the first receiver circuit 110 includes a receiver interface circuit, a latch circuit and at least one digital-to-analog converter (DAC). The receiver interface circuit of the first receiver circuit 110 may be a conventional data transmission interface circuit and thus, will not be repeatedly described. The latch circuit and the DAC of the first receiver circuit 110 may be inferred with reference to the related descriptions of the latch circuit 131 and the DACs 132_1 to 132_*n* illustrated in FIG. 7 and FIG. 8 and thus, will not be repeatedly described.

The multiplexer 120 is coupled to an output terminal of the digital-to-analog converter of the first receiver circuit 110 to receive the display data (i.e., the driving voltage) in the analog format. The multiplexer 120 is further coupled to the second receiver circuit 141 to receive the information data 102 (i.e., an information voltage) in an analog format. The first output circuit 130 includes a plurality of operational amplifiers (OPs). Input terminals of the operational amplifiers of the first output circuit 130 are respectively coupled to the at least one output terminal of the multiplexer 120. The operational amplifiers of the first receiver circuit 110 may be inferred with reference to the related descriptions of the OPs 133_1 to 133_*n* illustrated in FIG. 7 and FIG. 8 and thus, will not be repeatedly described.

In light of the foregoing, the driving apparatus for the display panel and the operation method thereof provided by the embodiments of the invention can achieve outputting the information data and the display data by sharing the first output circuit. The display data is configured to drive the display panel to present the image, while the information data is not configured to drive the display panel to present the image. Namely, the information data can be any information related to the driving apparatus, but not include pixel data. Thus, in some embodiments, the driving apparatus and the operation method thereof can achieve transmitting the complex information data on the premise that no additional pins are required, thereby saving the pin count. On the other hand, in some embodiments, the plurality of output channels of the first output circuit can simultaneously output the information data. Thus, the driving apparatus and the operation method thereof can achieve transmitting a great amount of information data within a short time, so as to save the transmission time of the information data. The saving of the transmission time can especially contribute to the efficiency of the testing procedure of integrated circuits.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving apparatus capable of driving a display panel, comprising:

a first output circuit, configured to output at least one driving voltage for driving at least one data line of the display panel;

a first receiver circuit, configured to receive display data for driving the display panel to present an image;

a multiplexer, having at least one first input terminal configured to receive information data, at least one second input terminal coupled to at least one output terminal of the first receiver circuit for receiving the display data, and at least one output terminal coupled to at least one input terminal of the first output circuit for transmitting the display data to the at least one input terminal of the first output circuit in a normal mode and transmitting the information data to the at least one input terminal of the first output circuit in a particular mode different from the normal mode, wherein the information data is not configured to drive the display panel to present an image; and an information data circuit, configured to provide the information data, wherein the information data circuit comprises a second receiver circuit configured to convert a voltage or current sensing result of the display panel into sensing data in the normal mode.

2. The driving apparatus according to claim 1, wherein the driving apparatus is further coupled to an external device configured to provide external information for the driving apparatus to obtain the information data.

3. The driving apparatus according to claim 2, wherein the external device is one of a device comprising a timing controller, a display panel, and a test apparatus.

4. The driving apparatus according to claim 2, wherein the driving apparatus is configured to receive the external information directly from the external device to serve it as the information data.

5. The driving apparatus according to claim 1, wherein the information data circuit is configured to internally generate the information data without receiving any information from any external device.

6. The driving apparatus according to claim 1, wherein the information data circuit is coupled to an external device configured to provide external information, and the information data circuit is configured to generate the information data according to the external information.

7. The driving apparatus according to claim 6, wherein the external device is one of a device comprises a timing controller, a display panel, and a test apparatus.

8. The driving apparatus according to claim 6, wherein the second receiver circuit is further configured to receive the external information from the external device and generate the information data according to the external information in the particular mode.

9. The driving apparatus according to claim 8, wherein the second receiver circuit comprises:

a sensing channel circuit, coupled to the display panel, and configured to sense a voltage or current to output the voltage or current sensing result; and an analog-to-digital converter, coupled to an output terminal of the sensing channel circuit, and configured to convert the voltage or current sensing result into at least one digital signal.

10. The driving apparatus according to claim 8, further comprising:

a second output circuit, configured to receive the sensing data output by the second receiver circuit and provide output data to a timing controller according to the received sensing data in the normal mode.

11. The driving apparatus according to claim 10, wherein the second output circuit comprises:

a latch circuit, coupled to an output terminal of the second receiver circuit, and configured to latch the sensing data or the information data output from the second receiver circuit; and a parallel-to-serial circuit, coupled to an output terminal of the latch circuit, and configured to convert the information data or the sensing data in a parallel format into a serial format.

12. The driving apparatus according to claim 1, wherein the multiplexer selectively transmits the display data of the first receiver circuit to the input terminal of the first output circuit such that the first output circuit drives the at least one data line of the display panel when the driving apparatus is operated in the normal mode.

13. The driving apparatus according to claim 1, wherein the multiplexer selectively transmits the information data to the input terminal of the first output circuit when the driving apparatus is operated in the particular mode.

14. The driving apparatus according to claim 1, wherein the first output circuit is configured to convert digital data of the input terminal of the first output circuit into an analog voltage and output the analog voltage via at least one output terminal of the first output circuit.

15. The driving apparatus according to claim 1, wherein the first output circuit comprises:

at least one operational amplifier having at least one input terminal coupled to the at least one output terminal of the multiplexer.

16. The driving apparatus according to claim 15, wherein the first output circuit further comprises:

at least one digital-to-analog converter coupled between the at least one output terminal of the multiplexer and the at least one input terminal of the at least one operational amplifier.

17. The driving apparatus according to claim 1, wherein the information data comprises a bit error number of the driving apparatus, analog-to-digital bit information of the driving apparatus or state information of the driving apparatus.

18. The driving apparatus according to claim 1, further comprising:

an information data circuit, configured to provide the information data, wherein the information data circuit comprises a state information register of a finite state machine of the driving apparatus which is configured to provide state information of the driving apparatus to serve it as the information data.

19. The driving apparatus according to claim 1, wherein the first receiver circuit further comprises:

a built-in self test (BIST) pattern generation circuit, configured to generate image data indicating at least one predetermined image pattern.

20. An operation method of a driving apparatus capable of driving a display panel, comprising:

receiving display data, by a first receiver circuit, for driving the display panel to present an image;

providing information data by an information data circuit, wherein the information data circuit comprises a second receiver circuit;

selectively transmitting the display data to at least one input terminal of a first output circuit in a normal mode and converting a voltage or current sensing result of the display panel into sensing data in the normal mode by the second receiver circuit, and transmitting the information data to the at least one input terminal of the first output circuit in a particular mode different from the normal mode by a multiplexer, wherein the information data is not configured to drive the display panel to present an image; and outputting at least one driving voltage, by the first output circuit, for driving at least one data line of the display panel.

21. The operation method according to claim 20, wherein the driving apparatus is further coupled to an external device configured to provide external information for the driving apparatus to obtain the information data.

22. The operation method according to claim 21, wherein the external device is one of a device comprises a timing controller, a display panel, and a test apparatus.

23. The operation method according to claim 21, wherein the driving apparatus is configured to receive the external information directly from the external device to serve it as the information data.

24. The operation method according to claim 20, wherein the information data circuit is configured to internally generate the information data without receiving any information from any external device.

25. The operation method according to claim 20, wherein the information data circuit is coupled to an external device configured to provide external information, and the operation method further comprises:

generating the information data according to the external information by the information data circuit.

26. The operation method according to claim 25, wherein the external device is one of a device comprises a timing controller, a display panel, and a test apparatus.

27. The operation method according to claim 25, wherein the operation method further comprises:

receiving the external information from the external device and generating the information data according to the external information in the particular mode by the second receiver circuit.

28. The operation method according to claim 27, wherein the second receiver circuit comprises a sensing channel circuit and an analog-to-digital converter, and the operation method further comprises:

sensing a voltage or current of the display panel to output the voltage or current sensing result by the sensing channel circuit; and converting the voltage or current sensing result into at least one digital signal by the analog-to-digital converter.

29. The operation method according to claim 27, wherein the driving apparatus further comprises a second output circuit, and the operation method further comprises:

receiving the sensing data output by the second receiver circuit and providing output data to a timing controller according to the received sensing data by the second output circuit in the normal mode.

30. The operation method according to claim 29, wherein the second output circuit comprises a latch circuit and a parallel-to-serial circuit, and the operation method further comprises:

latching, by the latch circuit, the sensing data or the information data output from the second receiver circuit; and converting, by the parallel-to-serial circuit, the information data or the sensing data in a parallel format into a serial format.

31. The operation method according to claim 20, wherein the step of selectively transmitting the display data to the at least one input terminal of the first output circuit in a normal mode and transmitting information data to the at least one input terminal of the first output circuit in the particular mode comprises:

selectively transmitting the display data of the first receiver circuit to the input terminal of the first output circuit by a multiplexer such that the first output circuit drives the at least one data line of the display panel when the driving apparatus is operated in the normal mode.

32. The operation method according to claim 20, wherein the step of selectively transmitting the display data to the at least one input terminal of the first output circuit in a normal mode and transmitting information data to the at least one input terminal of the first output circuit in the particular mode comprises:

selectively transmitting the information data to the input terminal of the first output circuit by the multiplexer when the driving apparatus is operated in the particular mode.

33. The operation method according to claim 20, further comprising:

converting digital data of the input terminal of the first output circuit into an analog voltage and outputting the analog voltage via at least one output terminal of the first output circuit by the first output circuit.

34. The operation method according to claim 20, wherein the first output circuit comprises at least one operational amplifier having at least one input terminal coupled to the at least one output terminal of the multiplexer.

35. The operation method according to claim 34, wherein the first output circuit further comprises at least one digital-to-analog converter coupled between the at least one output terminal of the multiplexer and the at least one input terminal of the at least one operational amplifier.

36. The operation method according to claim 20, wherein the information data comprises a bit error number of the driving apparatus, analog-to-digital bit information of the driving apparatus or state information of the driving apparatus.

37. The operation method according to claim 20, wherein the driving apparatus comprises an information data circuit configured to provide the information data, the information data circuit comprises a state information register of a finite state machine of the driving apparatus which is configured to provide state information of the driving apparatus to serve it as the information data.

38. The operation method according to claim 20, wherein the first receiver circuit further comprises a built-in self test (BIST) pattern generation circuit, and the operation method further comprises:

generating image data indicating at least one predetermined image pattern by the BIST pattern generation circuit.

* * * * *